US010181278B2

(12) United States Patent
Dighde et al.

(10) Patent No.: US 10,181,278 B2
(45) Date of Patent: Jan. 15, 2019

(54) DISPLAY DIODE RELATIVE AGE

(71) Applicant: Microsoft Technology Licensing, LLC, Redmond, WA (US)

(72) Inventors: Rajesh Dighde, Redmond, WA (US); Jacob Choi, Sammamish, WA (US); Matthew Morris, Seattle, WA (US); Ying Zheng, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 49 days.

(21) Appl. No.: 15/360,885

(22) Filed: Nov. 23, 2016

(65) Prior Publication Data

US 2018/0068606 A1 Mar. 8, 2018

Related U.S. Application Data

(60) Provisional application No. 62/383,950, filed on Sep. 6, 2016.

(51) Int. Cl.
*G09G 3/20* (2006.01)
*G09G 3/32* (2016.01)
(Continued)

(52) U.S. Cl.
CPC ..... *G09G 3/2003* (2013.01); *G09G 3/32* (2013.01); *G09G 3/3208* (2013.01);
(Continued)

(58) Field of Classification Search
CPC ..... G09G 3/3406; G09G 2320/0626; G09G 2380/10; G09G 3/3648; G09G 2330/021
See application file for complete search history.

(56) References Cited

U.S. PATENT DOCUMENTS 6,178,205 B1 1/2001 Cheung et al.
6,326,938 B1 12/2001 Ishida et al.
(Continued)

FOREIGN PATENT DOCUMENTS

CN 103198790 A 7/2013
EP 1772850 A1 4/2007
EP 2743908 A1 6/2014

OTHER PUBLICATIONS

Hudak, et al., "Black Panel Oled Cluster with Constant Luminance, Lifetime Enhancement and Burn-in Compensation", In Journal of SID Symposium Digest of Technical Papers, vol. 41, Issue 1, May 2010, 1 page.
(Continued)

*Primary Examiner* — Samantha (Yuehan) Wang
(74) *Attorney, Agent, or Firm* — Rainier Patents, P.S.

(57) ABSTRACT

The description relates to display devices. One example can receive a first frame rendering that expresses color content with a defined number of bits that convey a set of color states that correspond to a first range of voltages for driving light emitting diodes (LEDs) of a display. The example can obtain information about degradation of the LEDs of the display. The example can also combine the defined number of bits that express the color content with additional degradation compensation overdrive bits relating to compensating for the degradation of the LEDs of the display. The example can map the combined defined number of bits and the additional degradation compensation overdrive bits to a second range of voltages for driving the display where individual values of the second range exceed the first range.

20 Claims, 8 Drawing Sheets

(51) Int. Cl.
*G09G 3/3208* (2016.01)
*G09G 3/34* (2006.01)

(52) U.S. Cl.
CPC ..... *G09G 3/3413* (2013.01); *G09G 2320/029* (2013.01); *G09G 2320/0242* (2013.01); *G09G 2320/043* (2013.01); *G09G 2320/046* (2013.01); *G09G 2320/048* (2013.01); *G09G 2320/0693* (2013.01); *G09G 2360/16* (2013.01); *G09G 2360/18* (2013.01)

(56) References Cited

U.S. PATENT DOCUMENTS 6,414,661 B1 7/2002 Shen et al.
6,995,519 B2 2/2006 Arnold
7,211,452 B2 5/2007 Cok et al.
7,719,596 B2 5/2010 Katayama et al.
7,948,392 B2 5/2011 Smith et al.
7,990,346 B2 8/2011 Yamada
8,237,750 B2 8/2012 Polak et al.
8,325,115 B2 12/2012 Tada et al.
8,466,857 B2 6/2013 Yamaguchi
8,766,292 B2 7/2014 Kim et al.
8,797,367 B2 8/2014 Mori et al.
8,912,990 B2 * 12/2014 Vieri ..... G09G 3/3648 345/100
2002/0033783 A1 3/2002 Koyama
2002/0051086 A1 5/2002 Su
2002/0109696 A1 8/2002 Champion et al.
2003/0012434 A1 1/2003 Kanai
2003/0071804 A1 4/2003 Yamazaki et al.
2003/0201727 A1 10/2003 Yamazaki et al.
2004/0008208 A1 1/2004 Dresevic et al.
2004/0233125 A1 11/2004 Tanghe et al.
2005/0083353 A1 4/2005 Maruyama et al.
2005/0088379 A1 * 4/2005 Tsuchida ..... G09G 3/3258 345/76
2005/0110420 A1 5/2005 Arnold et al.
2005/0204313 A1 9/2005 Enoki et al.
2005/0212726 A1 9/2005 Namba et al.
2006/0273997 A1 12/2006 Nathan et al.
2007/0115440 A1 5/2007 Wiklof
2008/0042943 A1 * 2/2008 Cok ..... G09G 3/3225 345/77
2008/0150971 A1 6/2008 Kienhoefer
2008/0224966 A1 9/2008 Cok et al.
2008/0315890 A1 12/2008 Kasai et al.
2009/0015604 A1 1/2009 Ozaki et al.
2009/0046089 A1 2/2009 Zhuang et al.
2009/0115795 A1 5/2009 Pae et al.
2009/0122207 A1 5/2009 Inoue et al.
2009/0174628 A1 7/2009 Wang
2009/0213049 A1 8/2009 McCreary
2010/0085340 A1 4/2010 Omoto et al.
2010/0277400 A1 11/2010 Jeong
2011/0032430 A1 2/2011 Prieto et al.
2011/0144970 A1 6/2011 Jiang et al.
2011/0205498 A1 8/2011 Brown et al.
2012/0032991 A1 2/2012 Cha et al.
2012/0153861 A1 * 6/2012 Katsis ..... G09G 3/025 315/291
2012/0154453 A1 * 6/2012 Yamashita ..... G09G 3/3225 345/690
2012/0268501 A1 10/2012 Mizukoshi et al.
2012/0299978 A1 11/2012 Chaji
2013/0176324 A1 7/2013 Yamashita et al.
2013/0257884 A1 10/2013 Koh
2013/0265338 A1 10/2013 Chaji et al.
2013/0321361 A1 12/2013 Lynch et al.
2014/0375704 A1 12/2014 Bi et al.
2016/0086548 A1 * 3/2016 Maeyama ..... G09G 3/3258 345/690
2016/0267834 A1 9/2016 Zheng et al.
2016/0335965 A1 11/2016 Huang et al.

OTHER PUBLICATIONS

International Preliminary Report on Patentability dated May 10, 2017 from PCT Patent Application No. PCT/US2016/018564, 18 pages.
Chaji et al., "Stable RGBW AMOLED Display with OLED Degradation Compensation Using Electrical Feedback", Proceedings of the IEEE International Solid-State Circuits Conference Digest of Technical Papers, Feb. 7, 2010, 3 pages.
Second Written Opinion dated Jan. 31, 2017 from PCT Patent Application No. PCT/US2016/027652, 11 pages.
Second Written Opinion dated Jan. 18, 2017 from PCT Patent Application No. PCT/US2016/018564, 17 pages.
Response filed Dec. 19, 2016 to the International Search Report and Written Opinion dated May 11, 2016 from PCT Patent Application No. PCT/US2016/018564, 11 pages.
Response and Demand filed Dec. 15, 2016 to the International Search Report and Written Opinion dated Sep. 2, 2016 from PCT Patent Application No. PCT/US2016/027652, 13 pages.
International Search Report and Written Opinion dated Sep. 2, 2016 from PCT Patent Application No. PCT/US2016/027652, 23 pages.
International Search Report and Written Opinion dated May 11, 2016 from PCT Patent Application No. PCT/US2016/018564, 18 pages.
"Screen Burn-in Tool", Published on: Apr. 30, 2014, retrieved at: <<https://play.google.com/store/apps/details?id=com.codefortravel.amoled_screen_burn_in&hl=en>>, 2 pages.
Moynihan, Tim, "Today's Most Promising Display Technology may Already be Dead", published on Jun. 10, 2014, available at <<http://www.wired.com/2014/06/oled-could-be-dead/, 15 pages.
Pendlebury, Ty, "Seven Problems with Current OLED Televisions", published on Aug. 19, 2013, available at <<http://www.cnet.com/news/seven-problems-with-current-oled-televisions/>>, 7 pages.
Non-Final Office Action dated Dec. 22, 2016 from U.S. Appl. No. 14/711,689, 41 pages.
Response filed Jul. 7, 2017 to the Non-Final Office Action dated Apr. 7, 2017 from U.S. Appl. No. 14/656,664, 11 pages.
Advisory Action dated Sep. 5, 2017 from U.S. Appl. No. 14/711,689, 13 pages.
International Preliminary Report on Patentability dated Jul. 17, 2017 from PCT Patent Application No. PCT/US2016/027652, 12 pages.
Final Office Action dated Sep. 15, 2017 from U.S. Appl. No. 14/656,664, 30 pages.
Non-Final Office Action dated Apr. 7, 2017 from U.S. Appl. No. 14/656,664, 50 pages.
Response filed Mar. 22, 2017 to the Non-Final Office Action dated Dec. 22, 2016 from U.S. Appl. No. 14/711,689, 10 pages.

* cited by examiner

DISPLAY DIODE RELATIVE AGE

PRIORITY

This patent is a utility patent that claims benefit to provisional patent application 62/383,950, filed on Sep. 6, 2016, which is hereby incorporated by reference in its entirety.

BRIEF DESCRIPTION OF THE DRAWINGS

The accompanying drawings illustrate implementations of the concepts conveyed in the present document. Features of the illustrated implementations can be more readily understood by reference to the following description taken in conjunction with the accompanying drawings. Like reference numbers in the various drawings are used wherever feasible to indicate like elements. Further, the left-most numeral of each reference number conveys the FIG. and associated discussion where the reference number is first introduced.

DESCRIPTION

Displays can include multiple pixels that collectively create images. Individual pixels can be illuminated by one or more independently controllable light emitting diodes (LEDs). The LEDs can be designed to be driven at a range of voltages to produce defined color intensity values (e.g., color states). However, for various reasons the performance of the LEDs can degrade over time. The present concepts can provide solutions that both allow the LEDs to achieve the defined color states when new and as performance degrades.

Figure 1:
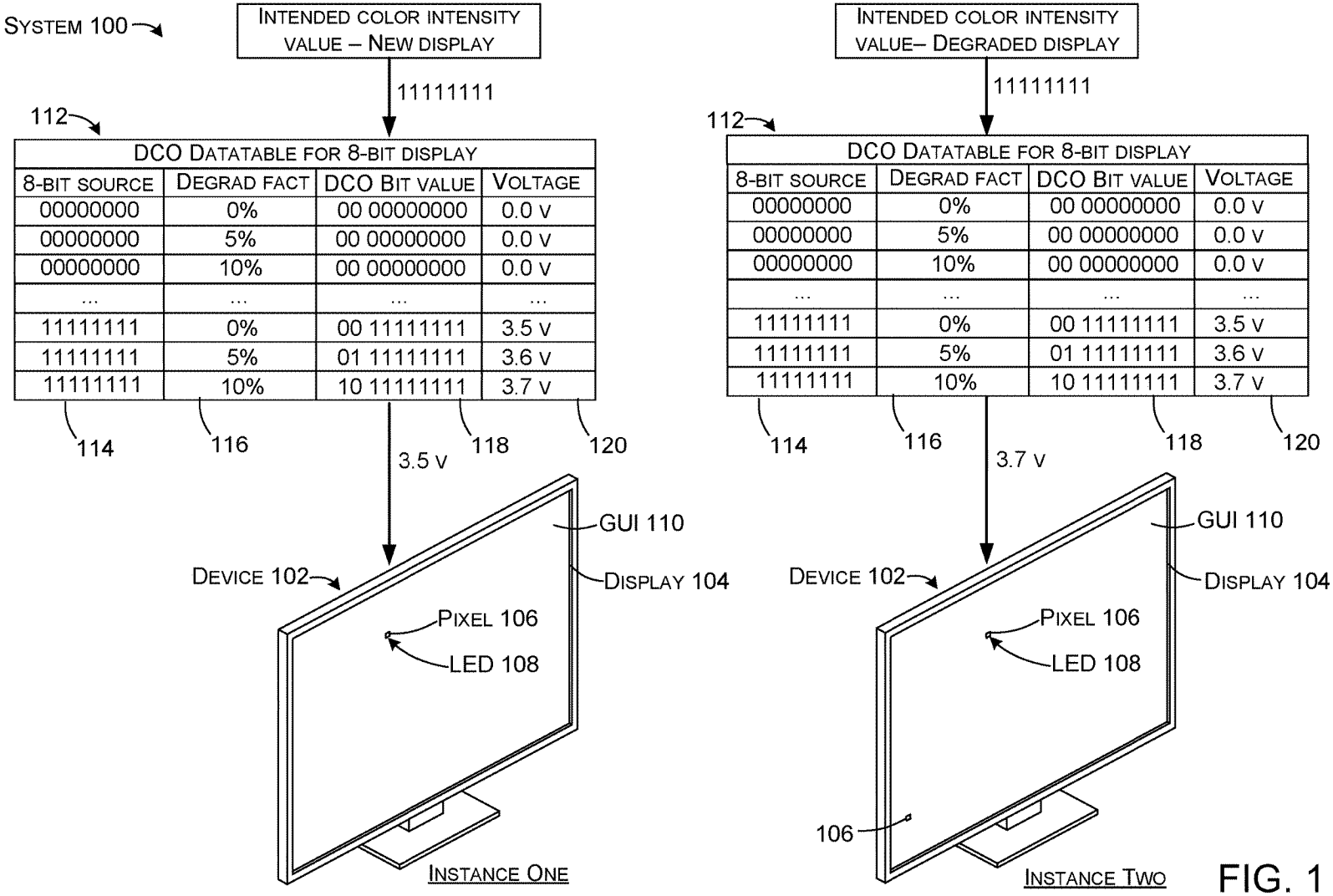
FIGS. 1-2 show display diode use case scenario examples in accordance with some implementations of the present concepts.
Figure 2:
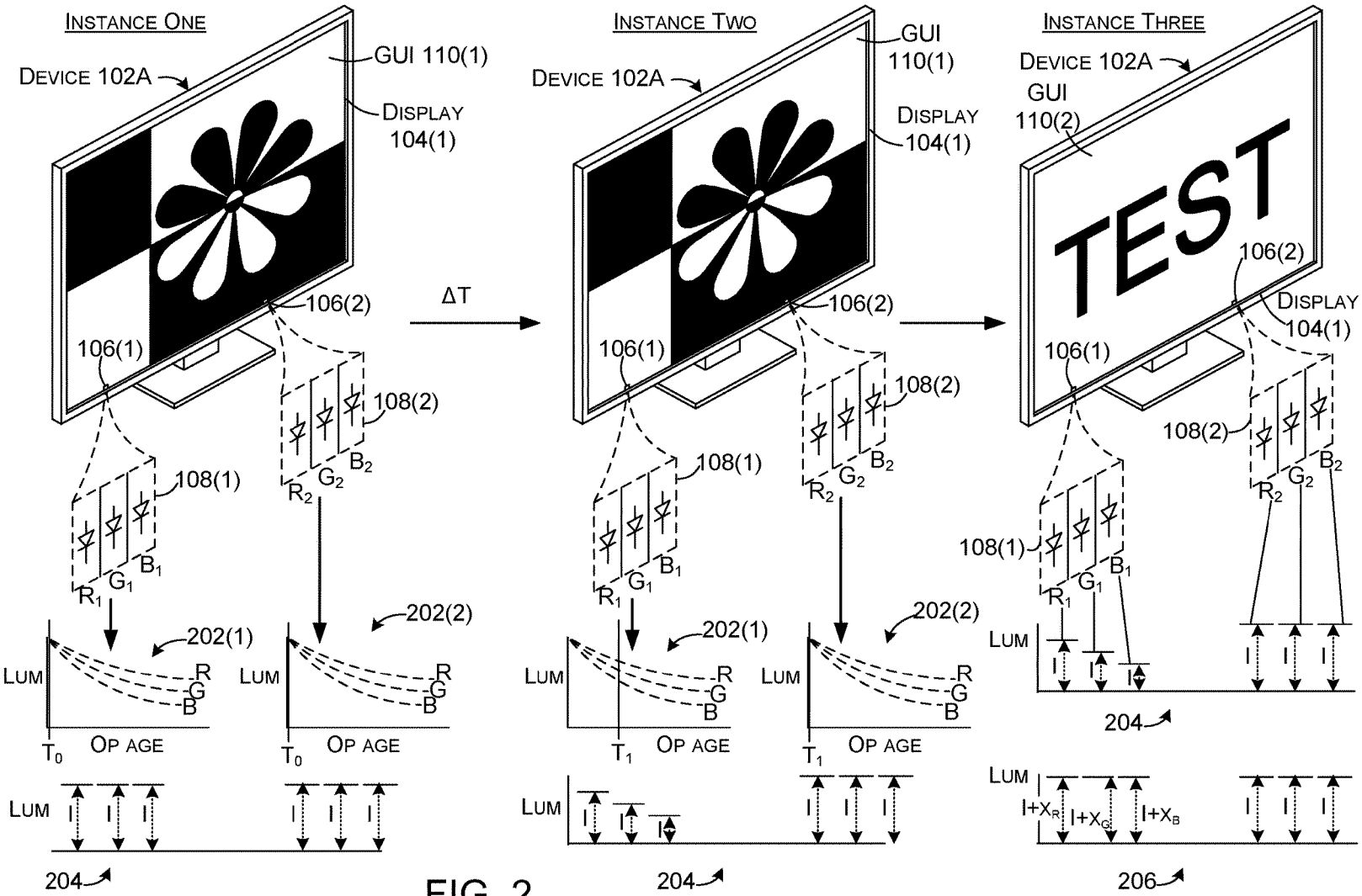

Introductory FIG. 1 shows an example implementation of some of the present concepts on a system 100 that can include a device 102. The device 102 can include a display 104. The display can include multiple independently controllable/addressable pixels 106 that are associated with individual LEDs 108. The LEDs of the pixels can be powered to collectively create an image or GUI 110. The pixels 106 of the display 104 can be designed to display a range of color states. (For ease of explanation in this introductory example, a single color (e.g., grayscale) example is described. FIG. 2 explains a multi-color example). A degradation compensating overdrive data table (e.g., DCO data table) 112 can correlate intended color intensity values, bit values, and/or driving voltages for the LEDs 108. The DCO data table 112 can include an 8-bit source value column 114, a degradation factor column 116, a degradation compensating overdrive bit value 118, and a voltage column 120.

In this example, the range of color states is 256 (e.g., from 0 to 255). These 256 color states can be represented using 8-bit binary numbers. As such, the display can be referred to as an 8-bit display which means that it is intended to display 256 color states. The LEDs 108 can be configured to be driven at a range of voltages to produce the 256 color states. In this example, the device 102 is configured such that driving the LED at 0 volts is designed to achieve the lowest (e.g., '0') color state and driving the LED at 3.5 volts is designed to achieve the highest (e.g., '256') color state (with the intermediate color state corresponding to intermediate voltage values). Note that 3.5 volts is selected for purposes of explanation as the highest voltage for a specific display design. Other display designs can employ other voltage values. For example, in another example display design the highest voltage might be 4 volts rather than 3.5 volts.

Traditionally, image information or content would be stored and sent (e.g., addressed) to the display 104 in a format that matched the number of color states of the display's pixels 106. For instance, an 8-bit display (e.g., a display employing 8-bit analog-to-digital convertors that drive the LEDs) would be addressed with 8-bit image information or renderings. However, the present concepts can generate color overdrive bytes of higher bits than the display. As used herein, 'byte' means a group of binary digits or bits that are operated on and/or stored as a unit. The group may comprise eight bits or some other value, such as 6, 10, 12, 14, 16, 32, and/or 64, among others. In this example, the 8-bit display 104 can be addressed with a single 10-bit overdrive byte and/or multiple bytes that conveys both intended color state information and information about the condition of the LEDs (e.g., degradation compensation overdrive information (overdrive information)). This extra overdrive information can be used to enhance the display so that the full range of color intensities can be displayed by the pixels as the display ages (e.g., 8-bits convey the color state as defined for the display as designed (e.g., in 'as-new' condition, the remaining overdrive bits address compensating for LED degradation by overdriving the LED)). Thus, from one perspective, 8 of the bits can be viewed as relating to image content (e.g., color content data) and the additional or overdrive bits (2 in this case) can be viewed as degradation compensation overdrive bits. This aspect relating to bits conveying color content data and additional bits conveying degradation data is described below relative to Instance One and subsequently Instance Two.

Instance One shows the display 104 in new condition (e.g., performing as-new or as designed). In this as-new condition, the pixels 106 can achieve all 256 color states at the range of defined voltages as designed. Thus, the lowest value (e.g., 0 of the range 0-255) can be represented by a 10-bit rendering or 8-bit+2-bit rendering of 00 00000000 (the space between the eighth and ninth bits is for ease of explanation) which maps to a driving voltage of 0.0 volts for LED 108. In this case, the LED is in as-new condition and as such the extra ninth and tenth bits may simply convey the as-new condition (e.g., no degradation therefore no overdrive compensation). Similarly, the highest color intensity value (e.g., 255) can be represented by a 10-bit rendering of eight ones and two zeros (e.g., 00 11111111) which maps to a driving voltage of 3.5 volts. Again, the LED is in as-new condition and thus the ninth and tenth bits can convey this fact. Thus, from one perspective, the extra bits (e.g., the $9^{th}$ and $10^{th}$ bits) may not perform any function when the 8-bit display in new condition because the range of color intensity values can be accurately conveyed with 8-bits. Stated another way, there is no disparity between the design parameters of the LED and the performance of the LED.

Instance Two shows the device 102 at a subsequent point where the display 104 has been used for a period of time, such as one year of 'on' time. This use can cause degradation of the performance of LED 108 such that driving the pixel at the same voltage as-new can produce a lower color state than when in as-new condition. For instance, if the pixel's LED is now powered at 3.5 volts, the displayed color state may be reduced by 5% or 10%, for example. Thus, the pixel is not as bright as designed. To achieve the desired brightest color intensity level of 255 the degraded LED can be driven with a higher compensation voltage. In this case, a 5% drop can be compensated by raising the voltage from 3.5v to 3.6v, for example, and a 10% drop can be compensated by raising the voltage from 3.5v to 3.7v, for example. Thus, at this point, the use of 10-bit rendering (or 8-bit+2-bit) to address the 8-bit display allows this additional degradation compensation overdrive value to be conveyed. The overdrive value and the color state can be mapped to a driving voltage by referencing rows of data table 112. Thus, in the 10% case, the overdrive information and the source color state can be conveyed as 10 11111111, for example.

Recall that only 256 states can be conveyed with 8-bits and all the bits were used in the as-new condition (e.g., the desired color state 255 can be conveyed in 8-bit binary as 11111111. In this example, the 10-bit binary number 10 11111111 can correspond to voltage 3.7 volts. Note that in this case, the first 8-bits starting at the right are used to convey the intended color state and the left 2-bits are used to convey degradation compensation overdrive information without change to the first 8-bits. Thus, in both Instance One and Instance Two, the intended or source color state is 255, which is represented by the right most 8-bits as 11111111. However, in Instance One, the state of the LED is 'as-new' as represented by the left most 00 bits. This 10-bit value (e.g., 0011111111) maps to 3.5 volts to achieve the intended color intensity value from the LED. In Instance Two, the rightmost 8-bits again convey the intended color intensity value of 255 as 11111111. However, the leftmost 2-bits have changed from 00 to 10 to indicate the degraded condition of the LED. This 10-bit value (e.g., 1011111111) can be mapped to 3.7 volts to achieve the intended color state (e.g., the increased voltage compensates for the degraded LED performance). This is one example of how the 10 bits (e.g., 8-bits+2-bits) can be used to improve LED performance. However, many other techniques can be employed. An alternative technique for using the extra bits is described below relative to FIG. 2. One intended point of explanation of this example is that 10-bits of information allows much more information to be conveyed than 8-bit color information (e.g., up to 1024 states versus 256 states). This additional information can be used in beneficial ways to control an 8-bit display as performance of its LEDs degrade. For instance, this information can allow the device to perform as designed when new (e.g., produce all 256 color states) and to continue to perform as designed despite degradation of the LEDs.

Continuing with the illustrated example, when driven at 3.7 volts in its present degraded state, pixel 106 can generate the brightest color intensity (e.g., 255) from the range of color intensities as was achieved with 3.5 volts in the as-new condition of Instance One. Thus, even though the LED has degraded, the intended color state can still be obtained from the pixel by driving the LED at a higher voltage. Therefore, the display can provide the full range (e.g., 256) of color states when the device is new and as the device ages. In contrast to previous solutions, this technique does not sacrifice brightness or color accuracy and instead allows the display to generate images employing the full range of color states (e.g., all 256 color states in the case of an 8-bit display) both when the device is new and as it ages. From one perspective, the present implementation can utilize additional bits, not to increase the resolution of the display, but to increase the dynamic range to compensate for LED degradation. For instance, in as-new condition, the resolution and the dynamic range may both be 0-256. However, as the LEDs degrade, the resolution can remain 0-256, but the dynamic range may increase to 0-300, for example.

FIG. 2 shows a device 102A and illustrates a display diode operational age example relative to device 102A. (The suffix 'A' is used relative to device 102A to convey that components of this device may or may not differ from other examples. To avoid clutter on the drawing page the 'A' suffix is not carried through to individual components). The device can include display 104(1). The display can include multiple pixels 106. For sake of brevity only two pixels 106(1) and 106(2) are designated with specificity. Individual pixels can include one or more independently controllable light emitting diodes (LEDs) 108, such as organic light emitting diodes, inorganic light emitting diodes, and/or other controllable devices or material, such as quantum dot materials. Individual pixels may also be implemented using an LCD, a color filter, and a backlight (in which the backlight itself may be comprised of one or more LEDs). In an LCD, it is possible that the LEDs in the backlight or the LCD pixels themselves may degrade or otherwise suffer from defects or distortion. In the example of FIG. 2, each pixel 106 includes a red (R) LED, a green (G) LED, and a blue (B) LED. For purposes of explanation, FIG. 2 shows device 102A at Instance One, Instance Two, and Instance Three.

As mentioned above, current light emitting diode (LED) displays can suffer from image degradation due to operational aging (e.g., performance degradation) of the light emitting materials (e.g., irreversible decrease of luminance with operation time) and/or screen burn in (e.g., different intensity of image across pixels). Moreover, different colors of LEDs, such as red, green, and blue emitting materials have different aging speeds. The present implementations can track this degradation and compensate for the degradation by overdriving the pixels to reduce performance loss of the display as it ages from use (e.g., performance degrades). The overdrive compensation can address multiple performance aspects, such as pixel to pixel illumination intensity and/or pixel image quality parameters, such as pixel color. The overdrive compensation can be achieved by the additional information that can be conveyed with the additional bits.

Starting at Instance One, assume for purposes of explanation that the device 102(1) is essentially new (e.g., 'as-new' condition at operational time $T_0$). At this point, a GUI 110(1) is presented on the display 104(1). Also, shown at Instance One is a performance degradation graph 202 for each pixel. The performance degradation graph charts diode luminosity over operational age for each color LED (e.g., R, G, and B) of the pixels of the display 104(1). Note that performance (e.g., luminosity) decreases with operational age. Note also that degradation graphs 202(1) and 202(2) are equal (and can be equal for all of the pixels of the device). Separate degradation graphs are shown for each pixel to show that individual pixels can experience different operational environments during the lifetime of the display 104. At this point, all of the LEDs of pixel 106(1) are performing 'as-new' at time $T_0$ (since they are in fact new) on degradation graph 202(1). Similarly, all of the LEDs of pixel 106(2) are performing as-new at time $T_0$ on degradation graph 202(2). Thus, as shown by luminosity graph 204, when driven at an equivalent color state or intensity value 'I', $R_1$, $G_1$, $B_1$, $R_2$, $G_2$, and $B_2$ would deliver the expected (and equal) luminosity (LUM). However, note that on GUI 110(1) of Instance One that pixel 106(1) is in a white-colored region of the GUI and pixel 106(2) is in a black-colored region. White color is generated at Instance One by driving $R_1$, $G_1$, and $B_1$ at equal intensities, such as 100% for example. As mentioned above, the 100% or highest color intensity can be represented as 255 on a scale of 0-255. Traditionally, 255 would be represented with 8-bits as 11111111. The present implementations can employ an extra bit or bits that relay degradation compensation overdrive information so for example, in an as-new state, 255 may be represented as 0011111111. In contrast, the black color is generated at Instance One by leaving $R_2$, $G_2$, and $B_2$ turned off (e.g., driving them at zero intensity or 0 on a resolution of 0-255). Traditionally, this could be represented in 8-bit binary as 00000000. The present implementation can utilize additional overdrive bits that relate to degradation compensation. Since the device is now in as-new condition, the degradation is zero and so the 0 can be represented in 10-bit binary as 0000000000. Note that the present concepts can be applied to scenarios where the device while new is not operating in 'as-new' condition. For instance, mechanical damage during assembly could cause degradation to individual LEDS such that degradation compensation could be applied when the device is first turned on to achieve the designed or intended color intensity values.

For purposes of explanation, assume that the state of Instance One is continued for a duration of time ($\Delta T$), such as 100 hours, until Instance Two.

At Instance Two, the GUI 110(1) has been displayed for 100 hours. At this point, as can be evidenced by comparing degradation graph 202(1) and 202(2), the operational age or effective age (represented by $T_1$) of the LEDs of pixel 106(1) are now different than the operational age ($T_1$) of the LEDs of pixel 106(2). For example, compare $T_1$ of degradation graph 202(1) to $T_1$ of degradation graph 202(2). Essentially, the R, G, and B LEDs 108(2) of pixel 106(2) are 'new' since they have not been powered (e.g., driven). In contrast, the R, G, and B LEDs 108(1) of pixel 106(1) have aged (e.g., $T_1$ on degradation graph 202(1) has shifted to the right). At this point, from an operational perspective, the LEDs 108(1) of pixel 106(1) are older than the LEDs 108(2) of pixel 106(2) and as such do not perform the same as the LEDs of pixel 106(2) or as they (e.g., LEDs 108(1)) did when they were 'new'. Further, because the degradation curves of red LEDs, green LEDs, and blue LEDs are different, the operational age of the red, green, and blue LEDs of pixel 106(1) are different from one another. This can be evidenced from the luminosity graph 204 of Instance Two. Recall that each LED is driven at the same intensity I. However, the resultant luminosities (vertical axis) of the LEDs of pixel 106(1) are less than those of the LEDs of pixel 106(2). Further, the blue LED pixel 106(1) has the lowest luminosity, the green LED has the intermediate luminosity and the red LED the highest luminosity (though still lower than all of the LEDs of pixel 106(2)). Assume that at this point GUI 110(1) is changed to GUI 110(2) of Instance Three.

Instance Three shows GUI 110(2) presented on display 104(1). On GUI 110(2) both pixel 106(1) and pixel 106(2) are white. Assume further that both pixels are intended to be the same 'color' white (e.g., identical colors) and the same intensity as one another. Recall however from the discussion of Instance Two that the LEDs 108 of these two pixels are no longer the same operational or effective age. The luminosity graph 204 from Instance Two is reproduced at Instance Three to illustrate this point. If driven at equivalent intensities, the luminosity of LEDs 108(1) varies among themselves and are lower than the luminosity of LEDs 108(2). This would produce two visual problems. First, pixel 106(1) would appear dimmer (e.g. less luminous) than pixel 106(2) on the GUI 110(2).

Second, recall that the specific color of white desired is accomplished by an individual pixel by equal luminosity from its red, green, and blue LEDS. However, in this case, the blue LED 108(1) is less luminous than the green LED 108(1), which is less luminous than the red LED 108(1). As such, the 'color' produced by pixel 106(1) will be different than the 'color' produced by pixel 106(2). For instance, pixel 106(1) might appear as 'off white' while pixel 106(2) appears as a 'true white'. For these two reasons, the displayed color state would not match the defined or intended color state. To address these issues, device 102(1) can adjust the color intensity value I that it drives the LEDs 108(1) of pixel 106(1) to create more uniformity of luminance and color between pixel 106(1) and 106(2). For example, assume that color intensity value I is 100% (e.g., 255 on a scale of 0-255). The LEDs 108(2) of pixel 106(2) can be driven at 100% intensity. Recall that in the as-new state, the 255-color intensity value can be conveyed in 10-bit binary as 0011111111. The LEDs 108(1) of pixel 106(1) can be driven at an intensity that is greater than I, such as I+X to get back to the luminance produced by LEDs 106(2) at 100% at Instance One.

Further, the 'X' value can be customized for each LED 108(1) to reflect its degradation curve as indicated at 206. For example, the X value for the blue LED (e.g., ($X_B$)) can be the largest since it has suffered the most performance degradation. The X value for the green pixel 106(1) (e.g., ($X_G$)) can be slightly less and the X value for the red pixel (e.g., ($X_R$)) can be even less. For instance, $X_B$ could equal 14%, $X_G$ could equal 12%, and $X_R$ could equal 10%. This information could not be conveyed using the 8-bits allocated to conveying the intended color state, but can be conveyed using extra overdrive bits, e.g., two extra bits in this example. Thus, $I+X_B$ can be conveyed as a 10-bit value that maps to a voltage higher than voltages applied in the as-new state. For instance, the 10-bit binary number 0100000111 could map to this voltage, such as 3.8 volts. $I+X_G$ can be conveyed as a 10-bit value that maps to a voltage higher than voltages applied in the as-new state. For example, the 10-bit binary number 0100000110 could map to this voltage, such as 3.7 volts. Similarly, $I+X_R$ can be conveyed as a 10-bit value that maps to a voltage higher than voltages applied in the as-new state. For instance, the 10-bit binary number 0100000110 could map to this voltage, such as 3.6 volts.

As noted above, multiple techniques of conveying additional information with the extra bits are contemplated beyond the specific illustrated and described examples. In fact, any technique can be employed that leverages the use of more bits than are required to convey the resolution (set of color states) of the as-new LEDs, such as 256 in the case of an 8-bit display or 1024 in a 10-bit display. The extra bits (e.g., overdrive bits) can allow extra information to be conveyed and this extra information can be mapped to actions that can be taken to maintain as-new performance for a longer duration than would otherwise be possible. From one perspective, the additional bits can allow the byte to convey more information (e.g., mores states) than the number of color states that can be displayed by the LEDs. This additional information or states can be mapped to LED degradation information (e.g., degradation compensation overdrive information) that enables compensating for degraded LEDs to achieve the defined color states.

Continuing with the above example, by driving LEDs 108(2) at 100% of their as-new range and red LED 108(1)

at 110%, green LED 108(1) at 112%, and blue LED 108(1) at 114% of their as-new range, the display can simulate the 'new' condition where all of the LEDs 108(1) and 108(2) would be driven at 100% to achieve the same color and luminosity. Note that this is a somewhat simplified example in that by using 'white' and 'black' the operational age of the LEDs of an individual pixel remain relatively close. However, if the GUI 110(1) in Instance One was blue and black for example, rather than white and black, and GUI 110(2) of Instance Three was white, then the blue LED 108(1) of pixel 106(1) would be aging at Instances One and Two, while the red and green LEDs 108(1) of pixel 106(1) were not. Such a scenario can be addressed in a similar manner to compensate for intra pixel LED degradation and interpixel LED degradation.

Note that in the example of FIG. 2, the degraded LEDs can be driven at voltages that are higher than the voltages defined for the device to achieve the set of color states in as-new condition. Some implementations may cap or limit the voltage increases (e.g., overdrive voltages) that can be used to compensate for the LED degradation. For instance, one implementation could limit the voltage increase to 120% of the maximum voltage in the range of voltages in the as-new condition. In these implementations that cap the voltage increases, the degradation graphs 202 and/or luminosity graphs 204 can allow the cap to be achieved in a graceful manner that maintains color integrity when approaching voltage caps. Stated another way, the voltage caps can limit luminance, but color integrity can be maintained by addressing degradation of individual color LEDs of individual pixels.

Figure 3:
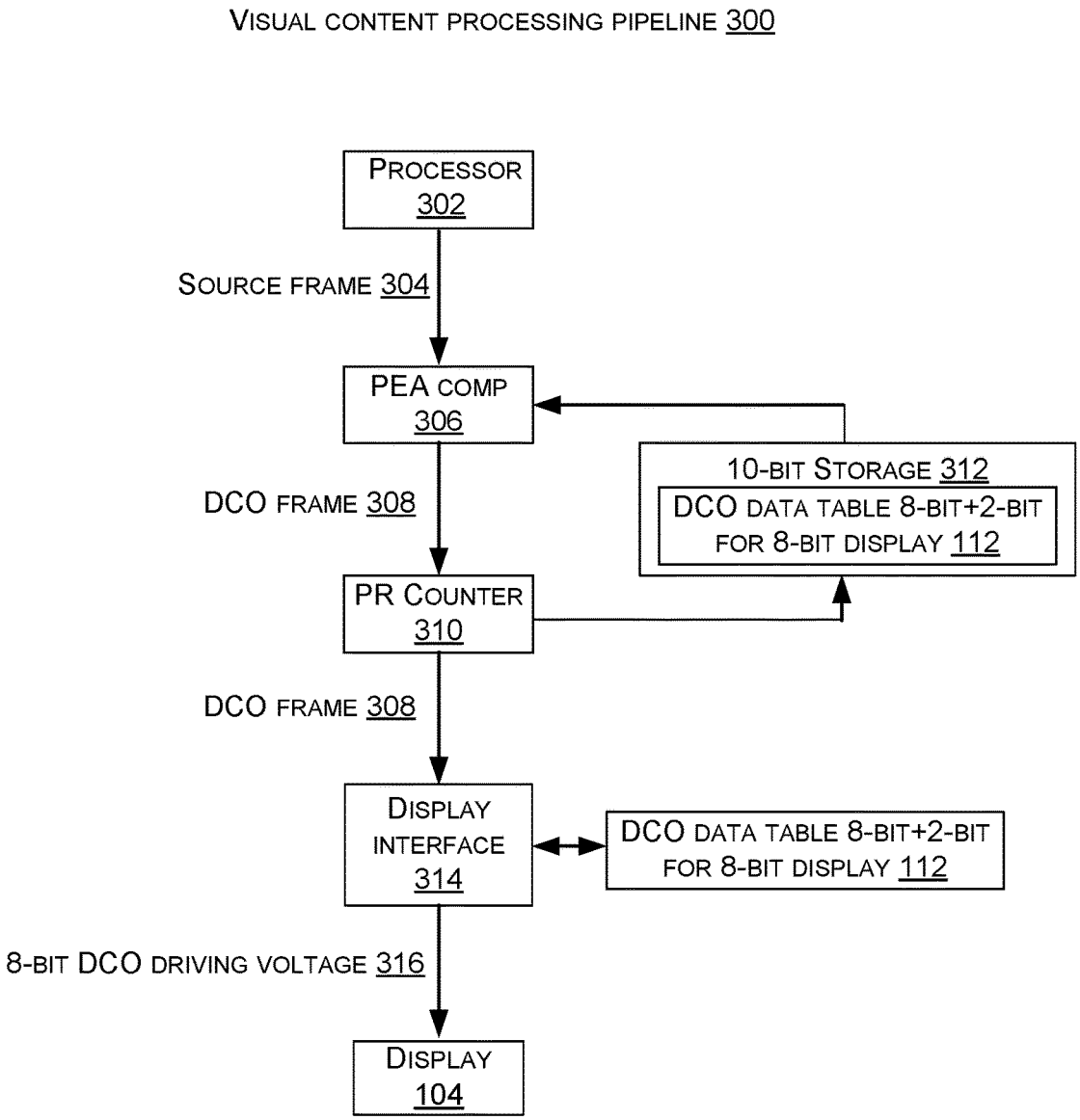
FIGS. 3-5 show visual content processing pipeline examples in accordance with some implementations of the present concepts.

FIG. 3 shows an example visual content (e.g., image) processing pipeline 300. In the visual content processing pipeline, processor 302 can operate on visual content, such as static and/or video content. The processor can generate a source frame or frame rendering 304 (e.g., 8-bit source image content or color content data that conveys desired color states) for presentation on the display 104 as a GUI 110. A pixel effective age compensation component 306 can receive the frame rendering from the processor. Assume for purposes of explanation that the display 104 is new and this is the first frame rendering. As such, the pixel effective age compensation component 306 does not perform any adjustment to the frame rendering other than to convert the source frame 304 to a degradation compensation overdrive frame (e.g., 8-bit image content+2-bit degradation compensation overdrive information) 308. The visual content processing pipeline 300 can be customized to an individual display model, since the properties of the hardware (e.g., the LEDs) may differ between models and/or manufacturers.

A pixel run-time counter 310 can receive the frame rendering from the pixel effective age compensation component 306 and determine whether to store information about the pixels on storage 312. In this example the storage is 10-bit storage. In some cases, the pixel run-time counter 310 can store pixel information about each frame rendering. Other implementations may regard such resource usage as prohibitive. These implementations may store information about individual frames selected based upon defined intervals, such as one frame every second or every three seconds, for example. Alternatively, the interval could be based upon a number of frames. For instance, the interval could be 50 frames or 100 frames, for example. For purposes of explanation, assume that the pixel run-time counter 310 saves pixel information about the pixels of this frame. The pixel information can relate to individual LEDs relative to individual frames. For instance, the information can relate to the color state (e.g., intended or defined color state) and the condition of the LEDs (e.g., degradation compensation overdrive information).

The pixel information can be stored in the degradation compensation overdrive information data table 112 in the storage 312. The pixel run-time counter 310 can store the color state information and the overdrive information in the degradation compensation overdrive information data table 112 as a 10-bit byte (e.g., 8-bits of intended color state and 2-bits of overdrive information). The 10-bit byte can alternatively be viewed as 8-bits of color state information annotated with 2-bits of LED condition information (e.g., degradation compensation overdrive information). The pixel run-time counter can also supply the 10-bit byte to a display interface 314 to drive the display pixels to present the frame on the display 104. The display interface 314 can utilize mappings in the degradation compensation overdrive data table 112 to identify a driving voltage at 316 that corresponds to the received 8-bit+2-bit information. The 8-bit+2-bit information supplied to the display interface can be used to select voltages for driving LEDs of the display 104 at the corresponding voltage to achieve the GUI specified in the source content even if the LEDs are degraded.

Now assume that the pixel effective age compensation component 306 receives another frame rendering (8-bit) from the processor 302. The pixel effective age compensation component can access the pixel information in the degradation compensation overdrive data table 112 and simulate or predict the operational age of individual pixels (e.g., their LEDs). The pixel effective age compensation component can then supplement the second frame with overdrive information about the condition of the LEDs (e.g., about their degradation and/or overdrive compensation levels for the degradation). As mentioned above, the pixel effective age compensation component 306 can compensate with voltage within the designed voltage range and/or above the designed voltage range to produce images matching the source content. Some implementations can increase voltages boundlessly to compensate for LED degradation. Other implementation may include a cap or limit on the voltages. For instance, an example implementation may limit voltages to 120% of the maximum voltage in the designed voltage range. For instance, if the designed voltage range is 0-3.5v, this implementation may limit the compensated voltages to a range of 0-4.2v. The pixel effective age compensation component 306 may utilize various techniques and manage compensation as voltage values approach the upper limit.

For instance, in some compensation techniques, the voltage adjustment can entail increasing the intensity of individual LEDs to restore their luminosity output to original levels (e.g., as-new condition). However, as mentioned above, in some instances this remedy is not available. For instance, if the LEDs are already being driven at a defined maximum voltage such as 120% of the defined voltage range, then they are not driven at a higher intensity and other solutions can be utilized.

Note that in this implementation, once the frame adjustment process is underway and frames can be viewed as being annotated by the pixel effective age compensation component 306 with extra bits of LED degradation information (e.g., degradation compensation overdrive information), each successive frame can be adjusted based upon the stored pixel information, and some subset of these adjusted frames can be stored by the pixel run-time counter 310. Stated another way, 8-bit color state renderings can be annotated with 2-bits of overdrive information as 10-bit bytes. The pixel run-time counter 310 can receive the annotated frame rendering and determine whether to store the pixel information according to the defined interval. Note that in this configuration, the pixel run-time counter 310 can store the pixel information of the annotated frame rendering rather than the original second frame rendering. Thus, the stored pixel information can convey the actual voltages that the LEDs are driven at rather than the voltages corresponding to the color states defined in the original second frame rendering. As such, the stored pixel information can provide a more accurate representation of the operational life or age of the LEDs. The pixel run-time counter can supply the annotated frame rendering to the display interface 314 to create the corresponding GUI on the display.

Figure 4:
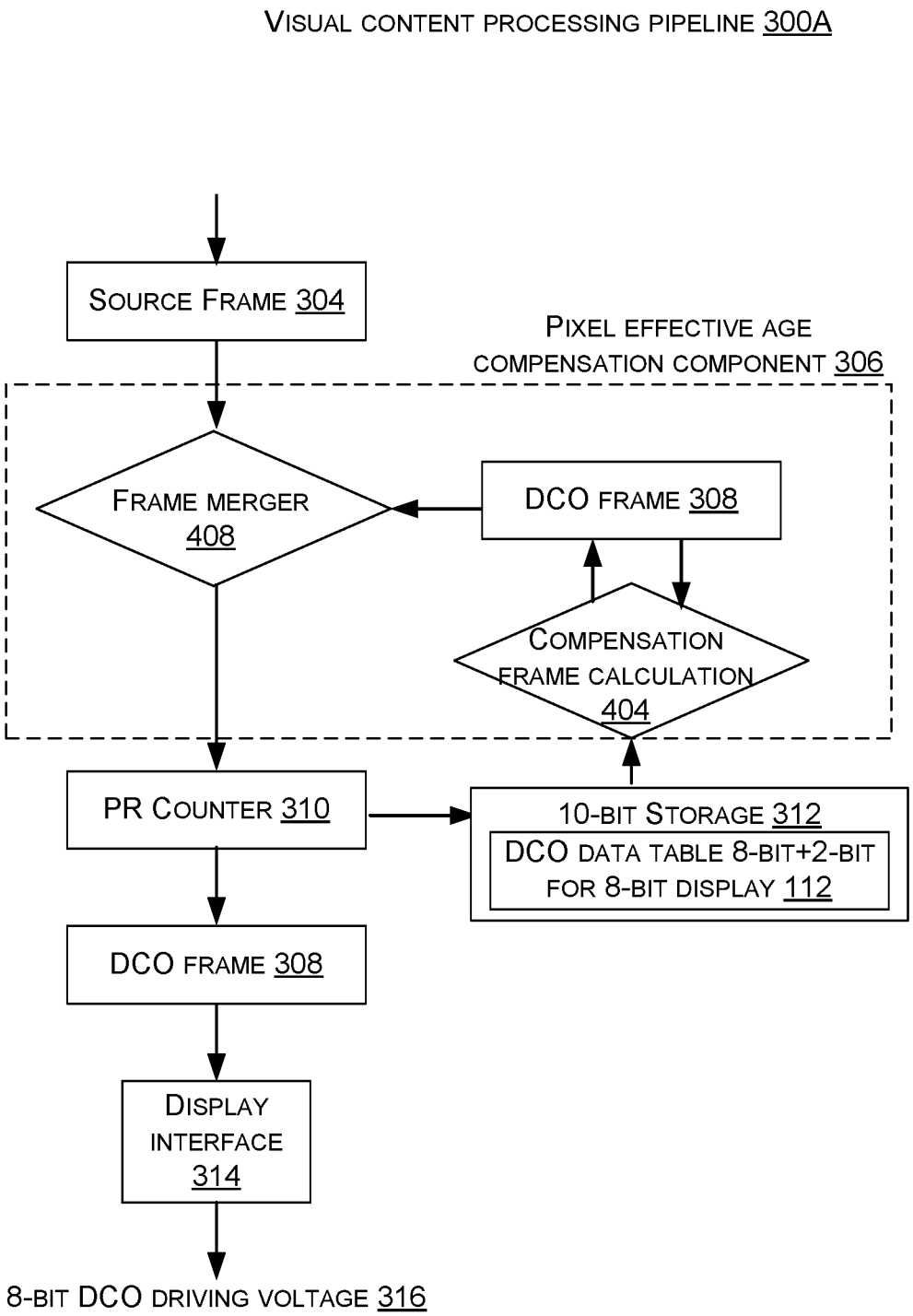

FIG. 4 shows an alternative visual content processing pipeline 300A. (The suffix 'A' is used relative to visual processing pipeline 300A to convey that components or elements may or may not differ from other examples. To avoid clutter on the drawing page the 'A' suffix is not carried through to individual components). In the illustrated configuration, a rendered source frame 304 can be received by the pixel run-time counter 310, which can store pixel information about the frame in the degradation compensation overdrive data table 112.

The pixel effective age compensation component 306 can use the pixel information to perform a compensation frame calculation 404 to generate a degradation compensation overdrive frame 308. The degradation compensation overdrive frame 308 can include more bits of information than the source frame. These additional bits can convey information about the condition of the display. In one version of this example, the frame rendering (e.g., source frame 304) can be a 10-bit byte and the degradation compensation overdrive frame 308 can be a 10-bit-+2-bit byte. The pixel effective age compensation component can then merge the degradation compensation overdrive frame 308 with the source frame 304 (e.g., frame merger 408).

Additional details of one example of the operation flow of the pixel run-time counter 310 are described below. In this implementation, the pixel run-time counter 310 can receive an individual frame and associated pixel information, such as LED conditions. The pixel run-time counter 310 can record the full frame RGB color state and LED conditions at the defined sampling rate. Once the frame's pixel information is recorded, the pixel run-time counter can calculate the run-time increment for individual sub-pixels based on the recorded data. The values of the run-time increment will be used to update the memory, where the accumulated run-time data is stored.

The pixel run-time counter 310 can function to convert the time increment of each frame's RGB grey levels into effective time increments at certain grey levels, like 1024 in a scenario using 10-bit sampling from 0-1024 in the source content color state and/or degradation compensation overdrive information. These values can be stored separately and/or as a combined 12-bit value. As mentioned above in an 8-bit source content scenario, each frame's RGB grey levels at effective time increments can be conveyed at certain grey levels, like 256 in a scenario using 8-bit sampling from 0-255 in the source content with degradation compensation overdrive information as additional bits (e.g., 8-bit+2-bit).

Returning to the flow chart of FIG. 4, the pixel effective age compensation component 306 can fetch the stored pixel information from the degradation compensation overdrive data table 112. The pixel effective age compensation component can calculate the degradation compensation overdrive frame based on the predictable degradation characteristics of the LED. Once the degradation compensation overdrive compensation frame is obtained, a compensation frame buffer can be updated. In the visual content processing pipeline 300(1), the source frame 304 from the processor can be fed to the pixel effective age compensation component 306 for the frame merger, in which the input frame (e.g., source frame 304) is merged with the degradation compensation overdrive frame 308 stored in the buffer. The merged degradation compensation overdrive frame 308 can then be sent to the display interface 314.

Figure 5:
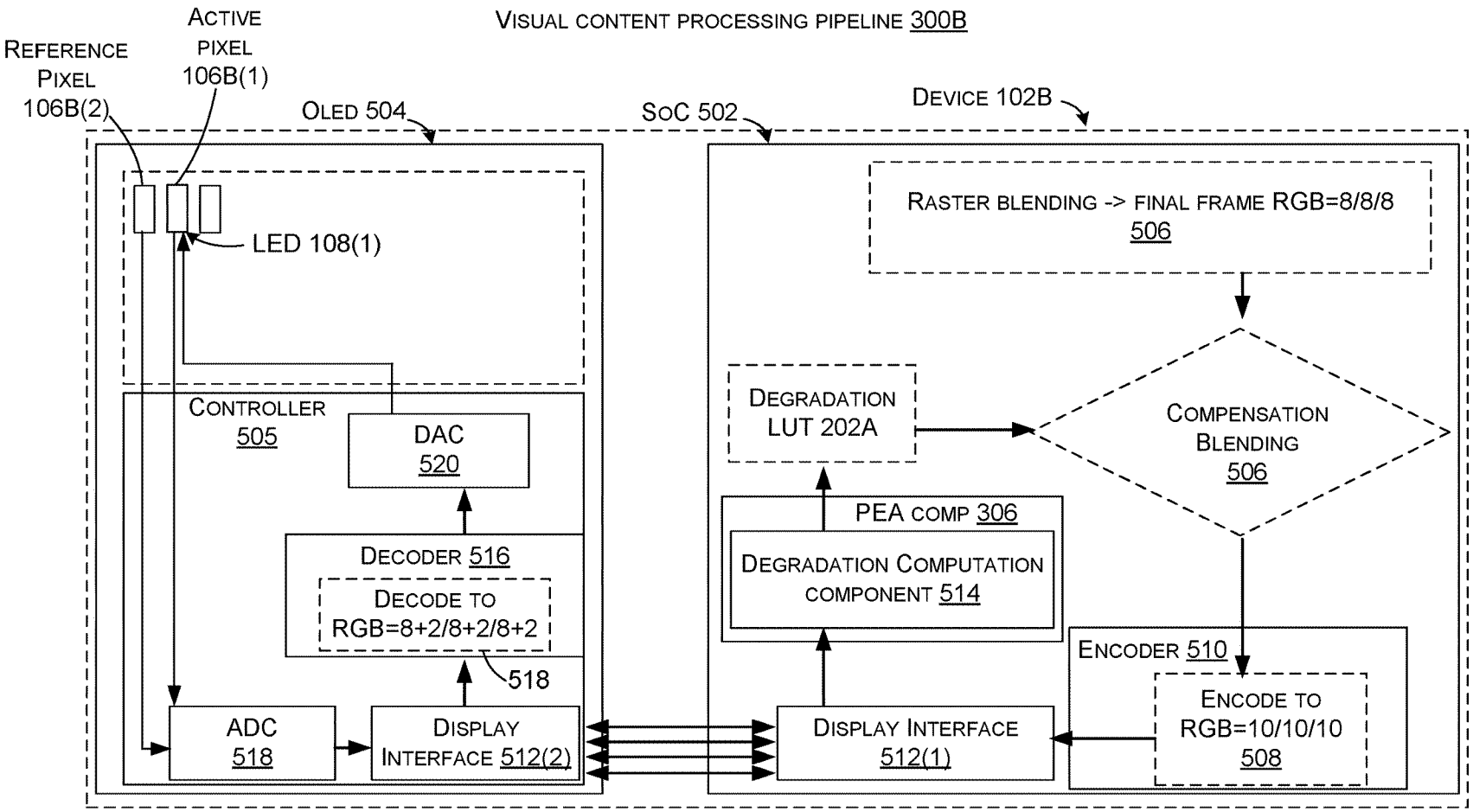

FIG. 5 shows another example visual content processing pipeline 300B explained relative to device 102B that includes a SoC 502 and an OLED display 504. The OLED display is a type of display 104 introduced above relative to FIG. 1. The OLED display 504 can be driven by a controller 505, such as a display driver integrated circuit (DDIC) or display timing controller (Tcon). (The suffix 'B' is used relative to visual processing pipeline 300B and device 102(2) to convey that components of this device may or may not differ from other examples. To avoid clutter on the drawing page the 'B' suffix is not carried through to individual components). OLED display 504 can include multiple LEDs 108 which power pixels 106.

Visual processing pipeline 300B is explained relative to an 8-bit+2-bit degradation compensation overdrive solution, but as mentioned above can be applied to other solutions, such as 8-bit+1-bit, 10-bit+2-bit, 12-bit+2-bit, etc. In this case, SoC 502 can perform image processing, such as rastor blending to produce a final 8-bit frame rendering (e.g., RGB=8/8/8) at 506 that conveys a desired or intended color state from the set of color states. The 8-bit frame rendering can be processed at 506 to provide compensation blending of the color content or color state bits with degradation compensation overdrive information. For instance, 8-bit color state bits can be combined with or otherwise annotated with 2-bits of degradation compensation overdrive bits and can be encoded as 10-bit bytes at 508 (e.g. encoded to RGB=10/10/10). The encoding can be performed by an encoder 510. The 10-bit bytes can be received at the display interface 512(1), which can bridge between the SoC 502 and the OLED 504.

Staying within the SoC 502, the display interface can provide the 10-bit bytes to degradation computation component 514. In some implementations, the degradation computation component can be a sub-component of the pixel effective age computation component 306 that is introduced above relative to FIGS. 3 and 4. The degradation computation component 514 can employ a degradation computation algorithm to identify an extent of pixel degradation (e.g., what is the effective age of the LEDs associated with the pixels). This aspect is discussed in detail above relative to FIGS. 2-4. The degradation computation component 514 can employ and/or update a degradation luminance over operational age graph (LUT) 202A to identify the extent of degradation of individual LEDs of individual pixels. Recall from the discussion above relative to FIG. 2 that different colors of LEDs can degrade at different rates and/or individual LEDs of the display can have different effective ages. The extent of degradation of individual LEDs can be used to calculate degradation compensation overdrive values. This aspect is also described above in detail relative to FIG. 2. Thus, the degradation computation component can receive the color states for the pixels in the encoded 10-bit bytes, identify the operational age of individual LEDs, and the overdrive voltages that can cause the LEDs to perform as intended (e.g., as new). The degradation computation component can determine how driving the LEDs at these overdrive voltages will affect the operational age of the LEDs and provide this information for compensation blending at 506. While not specifically illustrated, the SoC 502 can also include storage for storing the color states and degradation information, such as 10-bit storage for storing the encoded 10-bit (8-bit+2-bit) bytes. This aspect is described in detail above relative to FIGS. 3 and 4 where the bytes are stored in 10-bit storage in the DCO data table as 8-bit+2-bit for an 8-bit display.

On the OLED 504, decoder 516 can receive the RGB=10/10/10 and decode to RGB=8+2/8+2/8+2 data at 518. This process can be performed by a freestanding decoder 516 or the decoder can be a sub-component of digital-to-analog converter (DAC) 520. The DAC can determine driving voltages directly from the decoded RGB=8+2/8+2/8+2 data and/or from an instance of DCO data table 8-bit+2-bit for 8-bit display described above relative to FIGS. 1, 3, and 4. Recall that if the LED is in 'as-new' condition, the driving voltage can equal the driving voltage that maps the final frame RGB=8/8/8 506. If the LED has degraded, the voltage can be adjusted higher to achieve the defined color state. Thus, the overdrive bits can directly or indirectly relate to voltage levels for compensating for pixel degradation.

In the illustrated configuration, analog-to-digital converter (ADC) 518 can receive information about the state of the active pixel 106B(1) and/or reference pixel 106B(2), such as their relative brightness. This information can be sent to the degradation computation component 514 for consideration in further degradation correction calculations. Thus, this configuration can provide burn in level detection (e.g., delta between reference pixel and active pixel). This monitoring technique can be used alternatively or additionally to the degradation prediction technique described above relative to FIG. 3.

In review of the features of some implementations, displays can operate at their full color potential for a longer lifespan than would otherwise be the case. For instance, in the 8-bit configuration, the image data or rendering can define 256 color states or color intensity values that can be produced by the LEDs. These color states can be mapped to a range of voltages for driving the LEDs to generate the color states on the pixel. For instance, the lowest color state 0 (e.g., black) can correspond to a voltage of 0.0 volts and a highest color state (e.g., brightest white) can correspond to 3.6 volts. However, after suffering operational degradation, driving the LED at 3.6 volts might only generate an actual color state of 250 rather than a defined color state of 255.

The present implementations can select a voltage that is beyond the defined or first voltage range to compensate for the LED degradation. For instance, driving the LED at 3.8 volts might cause the LED to once again generate the highest color state of 255 on the pixel. The additional bits (e.g., the degradation compensation overdrive bits) can allow information about the state of the LED to be associated with the color state information so that the voltage adjustment can be made to maintain the appearance of the display 'as-new'. Further, this full color potential can be achieved by updating only a few components. For instance, in the 8-bit+2-bit example, the processor, whether that be processing on the SoC, on a general purpose processor (e.g., a CPU), on a graphics processor (GPU), etc., the processing can be standard 8-bit processing that defines 256 color states (e.g., color intensity values). No change to the processor is required. Similarly, the DAC and the display elements (e.g., LEDs) can be standard 8-bit components. Stated another way, the processing can define 256 color states for the pixel, the DAC can drive the LEDs at a corresponding first range of voltages so the LEDs can generate the 256 color states of the pixel. Intervening components can utilize the 8-bits that convey the 256 color states and additional bits (e.g., degradation compensation overdrive bits) that relate to the state of the LEDs.

When the LEDs are in as-new condition, the visual content processing pipeline can function in a traditional 8-bit manner. However, as the LEDs degrade the additional bits can be used to convey this LED degradation state along with the color state bits. Driving voltages for the LEDs can be increased to a second voltage range that includes voltages within and above the first voltage range in light of the degradation information in the additional bits to generate the defined color state (rather than a lower color state). In some implementations, only the encoder 510, decoder 516, and/or the degradation computation component 514 are configured to handle the extra bits (e.g., to handle 10-bit bytes). The DAC and/or the LEDs can be 8-bit components, which tend to be less expensive and more energy efficient than higher bit versions. Thus, the present implementations can present the full range of color states when the device is new and maintain the full range for extended operation despite degradation to the LEDs.

From one perspective, the visual content processing pipeline 300B can be suitable for OLED display implementations to offer high image quality with moderate hardware complexity. The hardware aspect can employ higher bit hardware between lower bit processing and LEDs. For instance, processing can generate 8-bit color states for 8-bit LEDs. The intervening components can handle more bits, such as 10-bits. The extra or additional bits (e.g., overdrive bits), such as two extra bits, are not used for extra color resolution, but are used to convey information about the condition of the LEDs. In one example, the encoder 510 can encode the extra two bits with the normal 8-bit color state image data into proprietary 10-bit RGB format. Using extra bits to convey degradation compensation overdrive information can allow luminance increases to maintain the full range of color states even as the LEDs degrade. In one implementation, the display panel controller 505 can extract or separate the intended color state information and the LED condition information from the encoded bytes. The display panel controller can determine LED driving voltages to achieve the intended color state in light of the condition of the LED.

The extra bits can be used for overcoming potential limitations of external compensation with algorithms and/or can be used in combination with external algorithms. The extra bits can provide a greater ability to compensate for various color related aspects, such as very high gray levels and/or low gray levels.

In some implementations, the overall software/hardware compensation architecture can be employed on the SoC side. Viewed from one perspective one concept relates to using overdrive bits on top of the conventional RGB color state bits to characterize additional luminance level on the panel for burn-in compensation. For example, the display driver IC design (e.g., controller 505) can be adapted with additional luminance level driving capability and can interpret the extra overdrive bits as burn-in compensation value. The actual OLED panel burn-in level can be used to compute the per-pixel compensation value. The OLED panel can provide raw burn-in status data to the SoC side. The SoC side can have full control on judging the burn-in severity and compensation level.

Figure 6:
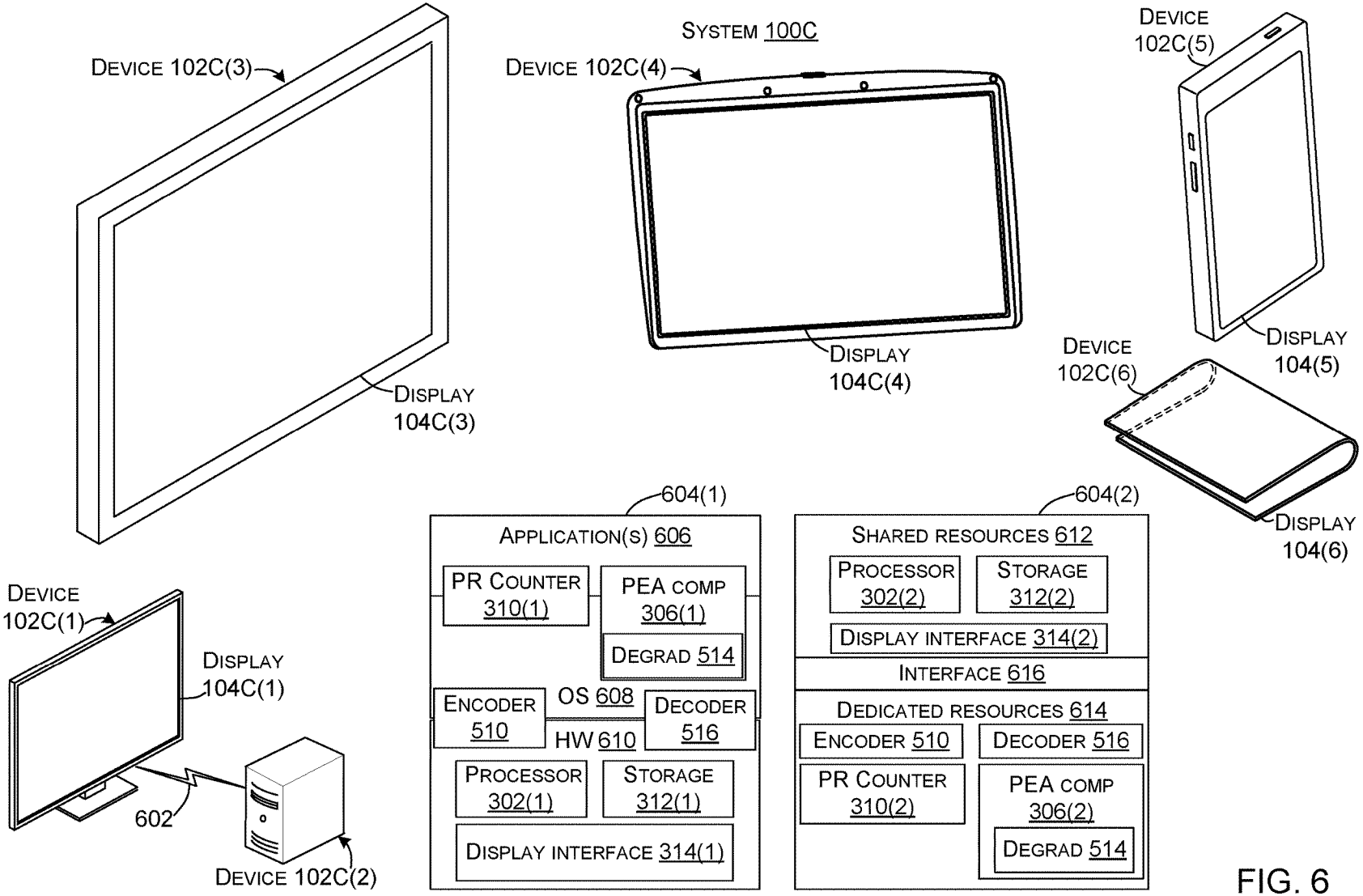
FIG. 6 shows a system example in accordance with some implementations of the present concepts.

FIG. 6 illustrates an example system 100C that shows various device implementations. In this case, five device implementations are illustrated. Device 102C(1) can operate cooperatively with device 102C(2) that is manifest as a personal computer or entertainment console. Device 102C(3) is manifest as a television, device 102C(4) is manifest as a tablet, device 102C(5) is manifest as a smart phone, and device 102C(6) is manifest as a flexible or foldable device, such as an e-reader, tablet, or phone that can be flexed into different physical configurations, such as opened or closed. Flexing the device can impart stress forces on individual pixels. The stress forces can degrade LED performance similarly to operational degradation.

Individual devices can include a display 104C. Devices 102C can communicate over one or more networks, such as network 602. While specific device examples are illustrated for purposes of explanation, devices can be manifest in any of a myriad of ever-evolving or yet to be developed types of devices.

Individual devices 102C can be manifest as one of two illustrated configurations 604(1) and 604(2), among others. Briefly, configuration 604(1) represents an operating system centric configuration and configuration 604(2) represents a system on a chip configuration. Configuration 604(1) is organized into one or more applications 606, operating system 608, and hardware 610. Configuration 604(2) is organized into shared resources 612, dedicated resources 614, and an interface 616 there between.

In either configuration, the devices 102C can include processor 302, storage 312, display interface 314, pixel run-time (PR) counter 310, and/or pixel effective age (PEA) compensation component 306 that can include degradation computation component 514. The devices can further include encoders and/or decoders 510 and 516. Individual devices can alternatively or additionally include other elements, which are not illustrated or discussed here for sake of brevity.

Devices 102C(1) and 102C(2) can be thought of as operating cooperatively to perform the present concepts. For instance, device 102C(2) may include an instance of processor 302, storage 312, display interface 314, pixel run-time counter 310, pixel effective age (PEA) compensation component 312. The device 102(2) can receive content data and process the content data into higher bit bites (e.g., 8+2) that include information about and/or compensate for effective aging of individual LEDs on the display of device 102C(1). Device 102C(2) can send higher bit bytes to device 102(1) for presentation on display 104(1). In contrast, devices 102(3)-102(5) may be self-contained devices that include both an instance of the display 104C and an instance of processor 302, storage 312, display interface 314, pixel run-time counter 310, and pixel effective age (PEA) compensation component 306. Thus, in this implementation, device 102C(2) can implement the present concepts and send the encoded higher bit bytes to device 102(1) for presentation.

In an alternative implementation, a device such as device 102C(3) could include a SoC configuration, such as an application specific integrated circuit (ASIC) that includes the pixel run-time counter 310, and pixel effective age compensation component 306. Such a device can maintain a high level of performance (e.g., display full color spectrum or all color states) and can continue this high level of performance even as it ages from use. Other device implementations, such as tablet device 102C(4) can include a processor, such as CPU and/or GPU that renders frames and can also execute the pixel run-time counter 310, and pixel effective age compensation component 306, on the same processor or on another processor.

From one perspective, any of devices 102C can be thought of as computers. The term "device," "computer," or "computing device" as used herein can mean any type of device that has some amount of processing capability and/or storage capability. Processing capability can be provided by one or more processors that can execute data in the form of computer-readable instructions to provide a functionality. Data, such as computer-readable instructions and/or user-related data, can be stored on storage, such as storage that can be internal or external to the computer. The storage can include any one or more of volatile or non-volatile memory, hard drives, flash storage devices, and/or optical storage devices (e.g., CDs, DVDs etc.), remote storage (e.g., cloud-based storage), among others. As used herein, the term "computer-readable media" can include signals. In contrast, the term "computer-readable storage media" excludes signals. Computer-readable storage media includes "computer-readable storage devices." Examples of computer-readable storage devices include volatile storage media, such as RAM, and non-volatile storage media, such as hard drives, optical discs, and/or flash memory, among others.

In one operating system centric configuration 604(1), the pixel run-time counter 310(1) can be embedded in an application 606 and/or the operating system 608 to record sub-pixel level run-time. The pixel effective age compensation component 306 can be similarly situated to receive information from the pixel run time counter, and utilize the information to adjust frame renderings and generate higher bits (e.g., 8+2) for delivery to the display interface 314(1).

As mentioned above, configuration 604(2) can be thought of as a system on a chip (SOC) type design. In such a case, functionality provided by the device can be integrated on a single SOC or multiple coupled SOCs. One or more processors can be configured to coordinate with shared resources 612, such as memory, storage, etc., and/or one or more dedicated resources 614, such as hardware blocks configured to perform certain specific functionality. Thus, the term "processor" as used herein can also refer to central processing units (CPUs), graphical processing units (GPUs), controllers, microcontrollers, processor cores, or other types of processing devices. The pixel run-time counter 310 and pixel effective age compensation component 306 can be manifest as dedicated resources 614 and/or as shared resources 612.

One example SOC implementation can be manifest as an application specific integrated circuit (ASIC). The ASIC can include the pixel run-time counter 310 and/or pixel effective age compensation component 306. For example, the ASIC can include logic gates and memory or may be a microprocessor executing instructions to accomplish the functionality associated with the pixel run-time counter 310 and/or pixel effective age compensation component 306, such as the functionality described below relative to FIGS. 1, 2, 3, 4 and/or 5. For instance, the ASIC can be configured to convert image data into frame renderings for multiple pixels. The ASIC can alternatively or additionally be configured to receive a frame rendering and to generate a higher bit byte that include color state and LED state/condition information. The additional LED condition information can be utilized to determine a driving voltage for the LEDs that will achieve the color state despite the degraded condition of the LED. In one implementation, the ASIC may be manifest in a monitor type device, such as device 102(3) that does not include another processor. In another implementation, the ASIC may be associated with a display in a device that also includes a CPU and/or GPU. For instance, in a device such as tablet device 102C(4), the ASIC may be associated with display 104C(4) and may receive frame renderings that include both color state information and LED degradation information that allows compensation of the LED to maintain as new performance with higher voltages.

Generally, any of the functions described herein can be implemented using software, firmware, hardware (e.g., fixed-logic circuitry), or a combination of these implementations. The term "component" as used herein generally represents software, firmware, hardware, whole devices or networks, or a combination thereof. In the case of a software implementation, for instance, these may represent program code that performs specified tasks when executed on a processor (e.g., CPU or CPUs). The program code can be stored in one or more computer-readable memory devices, such as computer-readable storage media. The features and techniques of the component are platform-independent, meaning that they may be implemented on a variety of commercial computing platforms having a variety of processing configurations.

Figure 7:
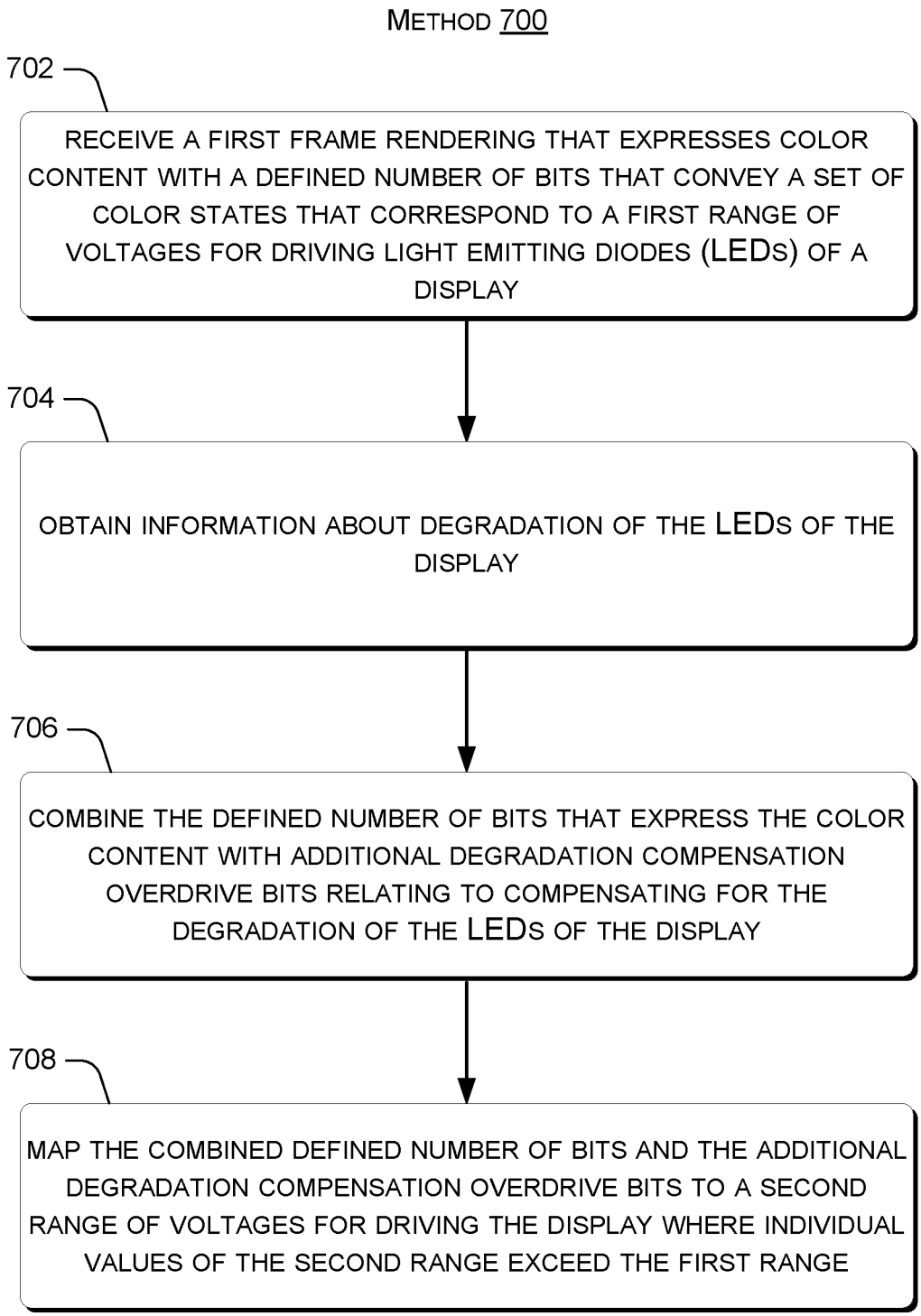
FIGS. 7-8 show example flowcharts in accordance with some implementations of the present concepts.

FIG. 7 shows an example method 700.

In this case, block 702 can receive a first frame rendering that expresses color content with a defined number of bits that convey a set of color states that correspond to a first range of voltages for driving light emitting diodes (LEDs) of a display.

Block 704 can obtain information about degradation of the LEDs of the display.

Block 706 can combine the defined number of bits that express the color content with additional degradation compensation overdrive bits relating to compensating for the degradation of the LEDs of the display.

Block 708 can map the combined defined number of bits and the additional degradation compensation overdrive bits to a second range of voltages for driving the display where individual values of the second range exceed the first range.

Figure 8:
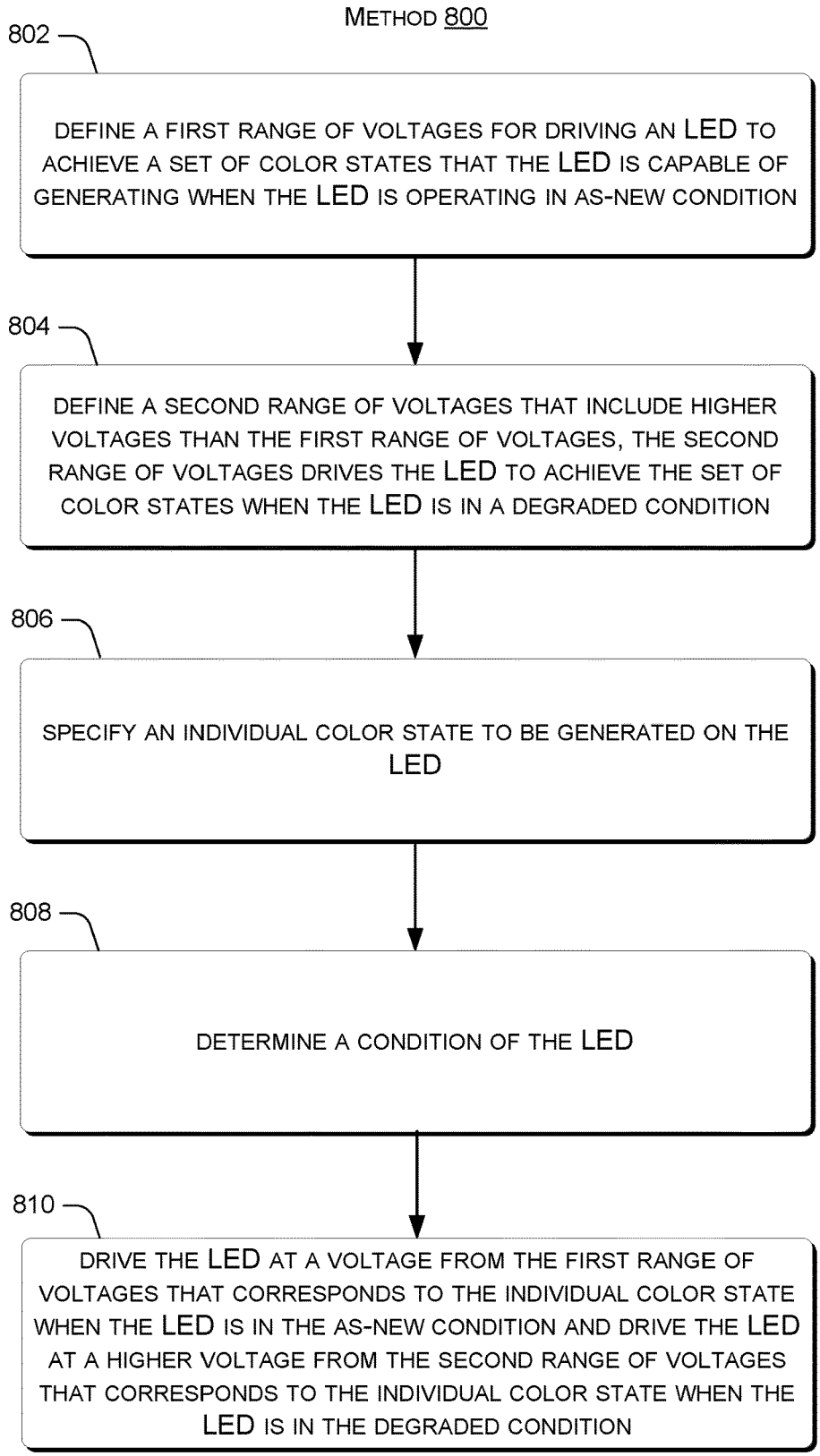

FIG. 8 shows an example method 800.

In this case, block 802 can define a first range of voltages for driving an LED to achieve a set of color states that the LED is capable of generating when the LED is operating in as-new condition.

Block 804 can define a second range of voltages that include higher voltages than the first range of voltages, the second range of voltages drives the LED to achieve the set of color states when the LED is in a degraded condition.

Block 806 can specify an individual color state to be generated on the LED.

Block 808 can determine a condition of the LED.

Block 810 can drive the LED at a voltage from the first range of voltages that corresponds to the individual color state when the LED is in the as-new condition and drive the LED at a higher voltage from the second range of voltages that corresponds to the individual color state when the LED is in the degraded condition.

The described methods or processes can be performed by the systems and/or devices described above relative to FIGS. 1-6, and/or by other devices and/or systems. The order in which the methods are described is not intended to be construed as a limitation, and any number of the described acts can be combined in any order to implement the method, or an alternate method. Furthermore, the method can be implemented in any suitable hardware, software, firmware, or combination thereof, such that a device can implement the method. In one case, the method is stored on computer-readable storage media as a set of instructions such that execution by a computing device causes the computing device to perform the method (e.g., a device-implemented method).

Although techniques, methods, devices, systems, etc., pertaining to display diode relative age correction are described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

Various examples are described above. Additional examples are described below. One example includes a device-implemented method comprises defining a first range of voltages for driving a light emitting diode (LED) to achieve a set of color states that the LED is capable of generating when the LED is operating in as-new condition. The method further defines a second range of voltages that include higher voltages than the first range of voltages. The second range of voltages drives the LED to achieve the set of color states when the LED is in a degraded condition. The method further comprises specifying an individual color state to be generated on the LED and determining a condition of the LED. The method further comprises driving the LED at a voltage from the first range of voltages that corresponds to the individual color state when the LED is in the as-new condition and driving the LED at a higher voltage from the second range of voltages that corresponds to the individual color state when the LED is in the degraded condition.

Another example can include any of the above and/or below examples where the set of color states comprises 256 color states or where the set of color states comprises 1024 color states.

Another example can include any of the above and/or below examples where the first range of voltages causes the LED to generate all color states in the set of color states in the new condition and the second range of voltages causes the LED to generate all color states in the set of color states in the degraded condition.

Another example can include any of the above and/or below examples where the first range of voltages comprises 0.0 volts to 3.5 volts and where the second range of voltages comprises 0.0 volts to 3.8 volts.

Another example can include any of the above and/or below examples where a highest color state of the set of color states is generated by the LED in the as-new condition by driving the LED with 3.5 volts and the highest color state of the set of color states is generated by the LED in the degraded condition by driving the LED with 3.8 volts, and wherein the highest color state in the as-new condition is the same as the highest color state in the degraded condition.

Another example can include any of the above and/or below examples where the driving produces all colors in the set of color states in the as-new condition and the degraded condition.

Another example can include any of the above and/or below examples where the device-implemented method further comprises generating a binary number that represents the individual color state and another binary number that represents conditions of the LED.

Another example can include any of the above and/or below examples where the device-implemented method further comprising encoding the binary number and the another binary number as a single byte.

Another example can include any of the above and/or below examples where the device-implemented method further comprising generating a binary number that represents the individual color state and conditions of the LED.

Another example can include any of the above and/or below examples of the device-implemented method wherein the binary number comprises sufficient bits to convey a greater number of states than the set of color states.

Another example can include a system comprising a display comprising multiple independently addressable LEDs that are configured to generate a set of color states when driven at a range of voltages. The system further comprises a processor configured to render image bytes that include a defined number of bits that specify individual color states for individual LEDs. The system further comprises a pixel effective age compensation component configured to determine a relative age of individual LEDs and to determine additional bits relating to degradation compensation overdrive for compensating for the relative age. The system further comprises a digital-to-analog converter configured to drive the individual LEDs at a second range of voltages that includes individual voltages that are higher than the range of voltages in accordance with the additional bits to achieve the set of color states despite the degradation.

Another example can include any of the above and/or below examples where the system further comprises an encoder configured to encode the defined number of bits that specify individual color states and the additional bits together as a single overdrive byte.

Another example can include any of the above and/or below examples of the system wherein the single overdrive byte maintains an individual image byte within the overdrive byte.

Another example can include any of the above and/or below examples of the system wherein the single overdrive byte conveys a state that defines both the individual color state and degradation compensation overdrive for the individual LEDs.

Another example can include any of the above and/or below examples where the system further comprises a decoder configured to decode the defined number of bits that specify individual color states from the additional bits.

Another example can include any of the above and/or below examples of the system wherein the processor is implemented on a computing device that is communicatively coupled to the display.

Another example can include any of the above and/or below examples of the system implemented on the display.

Another example can include any of the above and/or below examples where the system further comprises a degradation compensation overdrive data table that maps individual color states, degradation compensation overdrive, and driving voltages for the LEDs.

The invention claimed is:

1. A device-implemented method, comprising:

defining a first number of bits to convey a first range of voltages for driving a light emitting diode (LED) to achieve a set of color states that the LED is capable of generating when the LED is operating in as-new condition;

defining a second number of bits that includes the first number of bits plus additional degradation compensation overdrive bits to convey a second range of voltages that include higher voltages than the first range of voltages, where the second range of voltages drives the LED to achieve the set of color states when the LED is in a degraded condition;

specifying an individual color state to be generated on the LED;

determining a condition of the LED; and, driving the LED at a voltage from the first range of voltages that corresponds to the individual color state when the LED is in the as-new condition as conveyed by the first number of bits, and driving the LED at a higher voltage from the second range of voltages that corresponds to the individual color state when the LED is in the degraded condition as conveyed by the second number of bits that includes the additional degradation compensation overdrive bits.

2. The device-implemented method of claim 1, wherein the set of color states comprises 256 color states or wherein the set of color states comprises 1024 color states.

3. The device-implemented method of claim 1, wherein the first range of voltages causes the LED to generate all color states in the set of color states in the as-new condition and the second range of voltages causes the LED to generate all color states in the set of color states in the degraded condition.

4. The device-implemented method of claim 1, wherein the first range of voltages comprises 0.0 volts to 3.5 volts and wherein the second range of voltages comprises 0.0 volts to 3.8 volts.

5. The device-implemented method of claim 4, wherein a highest color state of the set of color states is generated by the LED in the as-new condition by driving the LED with 3.5 volts and the highest color state of the set of color states is generated by the LED in the degraded condition by driving the LED with 3.8 volts, and wherein the highest color state in the as-new condition is the same as the highest color state in the degraded condition.

6. The device-implemented method of claim 1, wherein the driving produces all colors in the set of color states in the as-new condition and the degraded condition.

7. The device-implemented method of claim 1, further comprising generating the first number of bits, wherein the first number of bits comprises a binary number that represents the individual color state and the additional degradation compensation overdrive bits comprise another binary number that represents conditions of the LED.

8. The device-implemented method of claim 7, further comprising encoding the binary number and the another binary number as a single byte.

9. The device-implemented method of claim 1, further comprising generating the second number of bits, wherein the second number of bits comprises a binary number that represents the individual color state and conditions of the LED.

10. The device-implemented method of claim 9, wherein the binary number comprises sufficient bits to convey a greater number of states than the set of color states.

11. A device-implemented method, comprising:

receiving a first frame rendering that expresses red, green, blue (RGB) color content with a defined number of bits that convey a set of RGB color states that correspond to a first range of voltages for driving light emitting diodes (LEDs) of a display;

obtaining information about degradation of the LEDs of the display;

combining the defined number of bits that express the RGB color content with additional degradation compensation overdrive bits per color relating to compensating for the degradation of the LEDs of the display; and, mapping the combined defined number of bits and the additional degradation compensation overdrive bits to a second range of voltages for driving the display where individual values of the second range exceed the first range.

12. The device-implemented method of claim 11, wherein the combined defined number of bits and the additional degradation compensation overdrive bits comprise eight bits of RGB color content data and two additional degradation compensation overdrive bits per color.

13. A system, comprising:

a display comprising multiple independently addressable LEDs that are configured to generate a set of color states when driven at a range of voltages;

a processor configured to render image bytes that include a defined number of bits that specify individual color states for individual LEDs;

a pixel effective age compensation component configured to determine a relative age of individual LEDs and to determine additional bits relating to degradation compensation overdrive for compensating for degradation associated with the relative age; and, a digital-to-analog converter configured to use a single overdrive byte that comprises the defined number of bits that specify individual color states and the additional bits to drive the individual LEDs at a second range of voltages that includes individual voltages that are higher than the range of voltages in accordance with the additional bits to achieve the set of color states despite the degradation.

14. The system of claim 13, further comprising an encoder configured to encode the defined number of bits that specify individual color states and the additional bits together as the single overdrive byte.

15. The system of claim 14, wherein the single overdrive byte maintains an individual image byte within the overdrive byte.

16. The system of claim 14, wherein the single overdrive byte conveys a state that defines both the individual color state and degradation compensation overdrive for the individual LEDs.

17. The system of claim 14, further comprising a decoder configured to decode the defined number of bits that specify individual color states from the additional bits.

18. The system of claim 13, wherein the processor is implemented on a computing device that is communicatively coupled to the display.

19. The system of claim 13, implemented on the display.

20. The system of claim 13, further comprising a degradation compensation overdrive data table that maps individual color states, degradation compensation overdrive, and driving voltages for the multiple LEDs.

* * * * *